US008128548B2

(12) United States Patent
Meikrantz et al.

(10) Patent No.: US 8,128,548 B2
(45) Date of Patent: Mar. 6, 2012

(54) CENTRIFUGAL SEPARATORS AND RELATED DEVICES AND METHODS

(75) Inventors: David H. Meikrantz, Idaho Falls, ID (US); Jack D. Law, Pocatello, ID (US); Troy G. Garn, Idaho Falls, ID (US); Lawrence L. Macaluso, Carson City, NV (US); Terry A. Todd, Aberdeen, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 621 days.

(21) Appl. No.: 12/338,148

(22) Filed: Dec. 18, 2008

(65) Prior Publication Data

US 2010/0160136 A1 Jun. 24, 2010

(51) Int. Cl.
*B04B 7/00* (2006.01)
*B04B 11/00* (2006.01)

(52) U.S. Cl. ..... 494/64; 494/31; 494/38

(58) Field of Classification Search ..... 494/22, 494/31, 32, 47, 48, 60, 62, 64, 38, 43, 85; 210/232, 234, 235, 236, 237, 360.1, 380.1
See application file for complete search history.

(56) References Cited

U.S. PATENT DOCUMENTS 3,845,788 A * 11/1974 Laven ..... 137/897
4,925,441 A * 5/1990 Jubin ..... 494/32
4,959,158 A * 9/1990 Meikrantz ..... 210/787
5,286,379 A * 2/1994 Jackson ..... 210/242.3
5,571,070 A * 11/1996 Meikrantz et al. ..... 494/22
5,591,340 A * 1/1997 Meikrantz et al. ..... 210/512.3
5,762,800 A * 6/1998 Meikrantz et al. ..... 210/512.3
5,908,376 A * 6/1999 Macaluso et al. ..... 494/29
6,363,611 B1 * 4/2002 Sheldon et al. ..... 29/889
6,699,169 B2 * 3/2004 Ogino et al. ..... 494/22
6,702,729 B2 * 3/2004 Mazzuca ..... 494/26
6,986,734 B2 * 1/2006 Carr ..... 494/46
7,150,836 B2 * 12/2006 Meikrantz ..... 210/748.07
7,767,083 B2 * 8/2010 Hoshino et al. ..... 210/232
7,794,383 B2 * 9/2010 Tetsu et al. ..... 494/7
2010/0160133 A1 * 6/2010 Meikrantz et al. ..... 494/10
2010/0160136 A1 * 6/2010 Meikrantz et al. ..... 494/37
2010/0294709 A1 * 11/2010 Hoshino et al. ..... 210/236

OTHER PUBLICATIONS

Meikrantz, David, et al., Continuous Liquid-Liquid Extraction Via an Improved Centrifugal Contactor, Cheresources.com, http://beta.cheresources.com/articles/continuous-liquid-liquid-extraction-via-an-improved-centrifugal-contactor.html, undated.
United States Patent Application entitled Centrifugal Separator Devices, Systems and Related Methods, filed Dec. 18, 2008.
Meikrantz, David, et al., Continuous Liquid-Liquid Extraction Via an Improved Centrifugal Contactor, Cheresources.com, http://beta.cheresources.com/articles/continuous-liquid-liquid-extraction-via-an-improved-centrifugal-contactor.html, (1998).

* cited by examiner

*Primary Examiner* — Charles E Cooley
(74) *Attorney, Agent, or Firm* — TraskBritt

(57) ABSTRACT

Centrifugal separators and related methods and devices are described. More particularly, centrifugal separators comprising a first fluid supply fitting configured to deliver fluid into a longitudinal fluid passage of a rotor shaft and a second fluid supply fitting sized and configured to sealingly couple with the first fluid supply fitting are described. Also, centrifugal separator systems comprising a manifold having a drain fitting and a cleaning fluid supply fitting are described, wherein the manifold is coupled to a movable member of a support assembly. Additionally, methods of cleaning centrifugal separators are described.

12 Claims, 8 Drawing Sheets

CENTRIFUGAL SEPARATORS AND RELATED DEVICES AND METHODS

GOVERNMENT RIGHTS

This invention was made with government support under Contract Number DE-AC07-05ID14517 awarded by the United States Department of Energy. The government has certain rights in the invention.

CROSS-REFERENCE TO RELATED APPLICATION

This application is related to U.S. patent application Ser. No. 12/337,988, filed Dec. 18, 2008, titled "CENTRIFUGAL SEPARATOR DEVICES, SYSTEMS AND RELATED METHODS," the disclosure of which application is incorporated herein in its entirety by reference.

TECHNICAL FIELD

The present invention relates to centrifugal separators and related devices and methods. More particularly, embodiments of the invention relate to centrifugal separators comprising a first fluid supply fitting configured to deliver fluid into a longitudinal fluid passage of a rotor shaft and a second fluid supply fitting sized and configured to sealingly couple with the first fluid supply fitting. Embodiments of the invention also relate to centrifugal separator systems comprising a manifold having a drain fitting and a cleaning fluid supply fitting, the manifold coupled to a movable member of a support assembly. Additionally, embodiments of the invention relate to methods of cleaning centrifugal separators.

BACKGROUND

Centrifugal separators use inertial forces resulting from the acceleration of a material, particularly the acceleration of a material in a circular path, for the separation of a heavier (more dense) material from a lighter (less dense) material. For example, such devices have been found to provide a relatively rapid method of separating immiscible liquids from one another based on different weight phases.

A centrifugal contactor is a type of centrifugal separator that is widely used for liquid-liquid separation, and particularly for solvent extraction processes. These centrifugal separators are termed "contactors" as fluid streams introduced separately into the device are brought together, or contacted, prior to a centrifugal separation of weight phases. For example, fresh water and an organic solvent contaminated with salts may be fed into separate inlets and rapidly mixed in an annular space between a spinning rotor and a stationary housing. The salts may migrate from the organic solvent to the water as they are mixed in the annular space. The water and organic solvent are then centrifugally separated and exit through separate outlets, thus washing salts from the organic solvent with the water.

During normal use, particularly when separating water/petroleum mixtures, solids suspended within the mixture tend to accumulate in the interior of the centrifugal contactor assembly. Such solids are difficult to remove from a welded, enclosed assembly, and back-flushing of the centrifugal contactor has not produced satisfactory results. Better results have been obtained by disassembling the centrifugal contactor and removing the rotor assembly. However, this is a time-consuming operation, and causes the centrifugal contactor to be removed from service for an extended period of time.

To solve this problem, inventors of the present invention disclosed in U.S. Pat. No. 5,908,376 a self-cleaning or "clean-in-place" rotor assembly that can thoroughly clean a centrifugal contactor of accumulated solids without disassembly thereof. The clean-in-place rotor assembly of the centrifugal contactor has a double-ended hollow axial shaft with a bottom end extending through the centrifugal contactor housing. In order to provide a pressurized cleaning solution to the hollow axial shaft, the bottom end of the axial shaft is coupled to a rotary union. The pressurized cleaning solution is then directed from the rotary union into the hollow axial shaft and through a plurality of spray nozzles that are fitted to the axial shaft, which impinges a stream of the pressurized cleaning solution onto the interior surfaces of the centrifugal contactor to remove accumulated solids therefrom.

However, the rotary union used to couple the cleaning fluid supply to the bottom end of the axial shaft has experienced several problems in use. The rotary union is composed of several moving parts, including a bearing and seal assembly that may wear or become damaged during normal use, or during repair or servicing of the centrifugal contactor. Because the rotary union is attached to the bottom end of the axial shaft, the rotary union is otherwise unsupported and, thus, subject to damage due to the constant stress of vibrations from fluid connections and bumps during maintenance or service. The rotary union is also subject to process fluid-related corrosion and wear, resulting in eventual leakage and failure, thus making the rotary union a weak link in centrifugal contactor reliability. This is such a widespread problem with rotary unions that rotary union manufacturers typically limit their warranty to steam, oils, water and other benign fluids. The presence of corrosives, caustics and solids in the centrifugal contactor process streams thus typically voids manufacturer's warranties, as the rotary union is continuously exposed to the process chemistry during the rotary union's installed use in such applications. Additionally, the installation and removal of a rotary union from a centrifugal contactor may require the manipulation of a tool, such as a wrench, in a space between the body of the rotary union and the bottom of the centrifugal contactor, which may be difficult and time consuming.

In view of the above, it would be advantageous to provide improved centrifugal separators and related devices, systems and methods.

SUMMARY

In one embodiment, a centrifugal separator comprises a rotor shaft, a first fluid supply fitting proximate a tail end of the rotor shaft, a second fluid supply fitting sized and configured to sealingly couple with the first fluid supply fitting and a support assembly having a movable member coupled to the second fluid supply fitting. The rotor shaft of the centrifugal separator includes a longitudinal fluid passage therein having an opening at the tail end of the rotor shaft. The first fluid supply fitting, located proximate the tail end of the rotor shaft, is configured to deliver fluid into the longitudinal fluid passage through the opening at the tail end of the rotor shaft. The support assembly includes a fixed member coupled to the movable member, such that the movable member, which is coupled to the second fluid supply fitting, is constrained to movement along a fixed path relative to the fixed member. The support member additionally includes an actuator configured to move the movable member along the fixed path.

In another embodiment, a centrifugal separator system comprises a centrifugal separator supported in a frame, a manifold and a support assembly having a movable member coupled to the manifold. The centrifugal separator includes a drain assembly and a cleaning fluid delivery structure and the manifold includes a drain fitting and a cleaning fluid fitting. The support assembly includes a fixed member fixed relative the frame and coupled to the movable member. The support assembly also includes an actuator coupled to each of the fixed member and the movable member. The actuator is configured to move the drain fitting into sealing contact with the drain assembly and move the cleaning fluid fitting into sealing contact with the cleaning fluid delivery structure.

An additional embodiment comprises a method of cleaning a centrifugal separator. The method comprises holding a rotor shaft, and a first fluid fitting coupled to a tail end of the rotor shaft, substantially stationary. Additionally, the method comprises operating a linear actuator to move a second fluid fitting into contact with the first fluid fitting and slidably coupling the first and second fluid fittings to form a fluid-tight seal and directing a pressurized cleaning fluid from the second fluid fitting into the first fluid fitting and into a longitudinal fluid passage of the rotor shaft. The method also comprises moving the second fluid fitting out of contact with the first fluid fitting.

DETAILED DESCRIPTION

Figure 1:
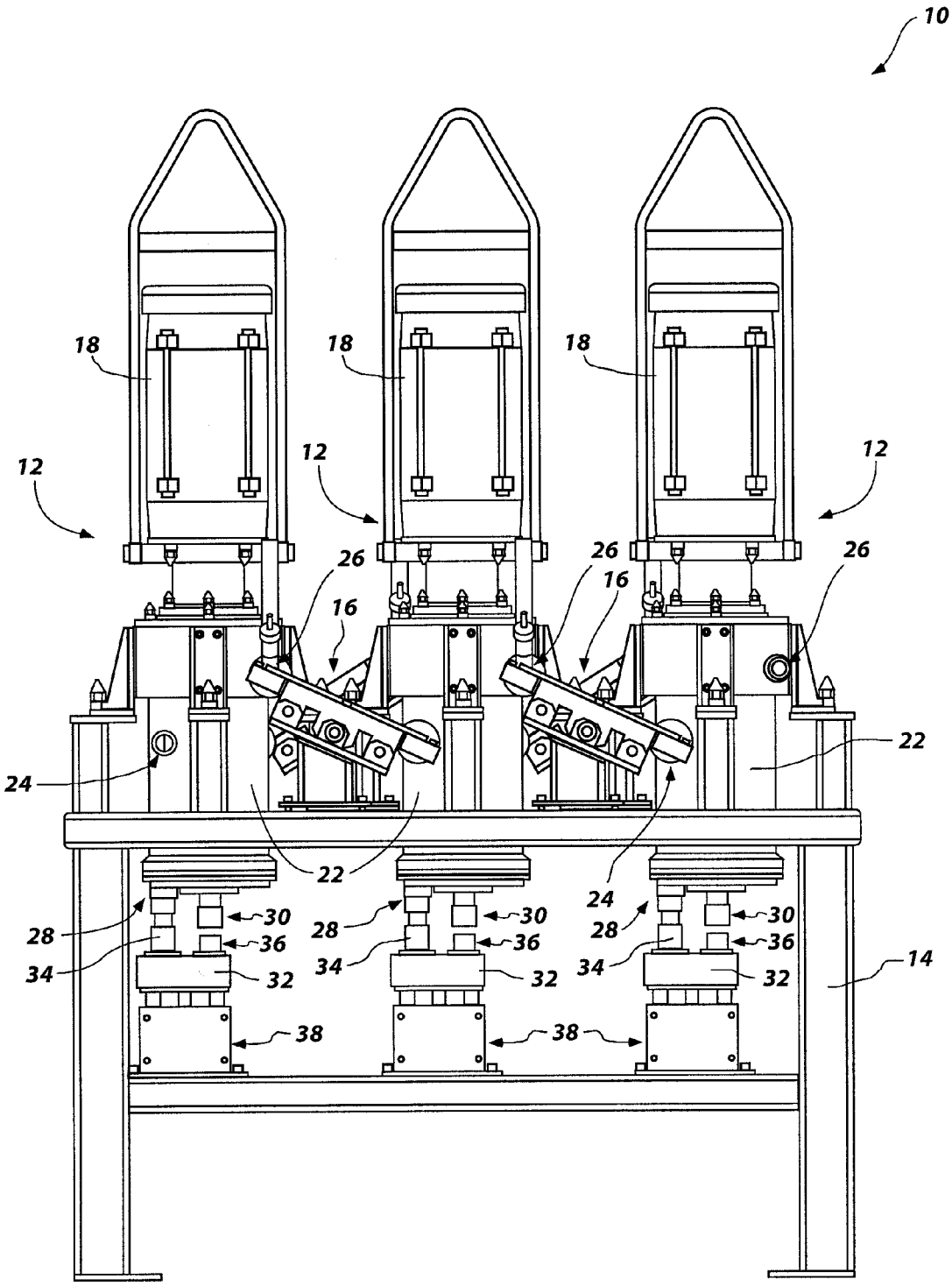
FIG. 1 shows a front view of a centrifugal separator system including centrifugal separators according to an embodiment of the invention.

A centrifugal separator system, according to an embodiment of the invention, is shown in FIG. 1. The centrifugal separator system 10 includes at least one centrifugal separator, such as a plurality of centrifugal contactors 12, supported by a frame 14 as illustrated. The centrifugal separator system 10 further includes fluid transfer connections 16 that may be arranged to interconnect the centrifugal contactors 12, or to connect a centrifugal contactor 12 to another fluid processing device or to an inlet or outlet source (not shown).

Each centrifugal contactor 12 of the centrifugal separator system 10 may include a motor, such as an electric motor 18. Additionally, the electric motor 18 may include a shaft coupled to a rotor shaft 20 (see FIGS. 2A and 2B, note: a complete rotor assembly is not shown) within a stationary housing 22. A generally annular-shaped separation chamber (not shown) may be located within the housing 22, surrounding the rotor shaft 20, and a plurality of fluid inlet and outlet ports may be in fluid communication with the separation chamber. For example, a heavy or mixed phase inlet 24 and a heavy phase outlet 26 may be located at one side of each centrifugal contactor 12, and a light or mixed phase inlet and a light phase outlet (not shown) may be located at another side. Additionally, each centrifugal contactor 12 of the centrifugal separator system 10 may include a drain assembly 28 and a fitting, such as a clean-in-place (CIP) fluid delivery fitting 30, located at the bottom thereof.

Examples of such centrifugal separators and system configurations are disclosed in, for example, the aforementioned and incorporated by reference U.S. patent application Ser. No. 12/337,988, filed Dec. 18, 2008, titled "CENTRIFUGAL SEPARATOR DEVICES, SYSTEMS AND RELATED METHODS," of Meikrantz et al.

A manifold 32 may be positioned below each centrifugal contactor 12 and may include a drain fitting 34, which corresponds to the drain assembly 28, and another fitting, such as a fluid supply fitting 36, which corresponds to the CIP fluid delivery fitting 30. The manifold 32 may be coupled to a support assembly 38 having a component fixed to the frame 14.

Figure 2A:
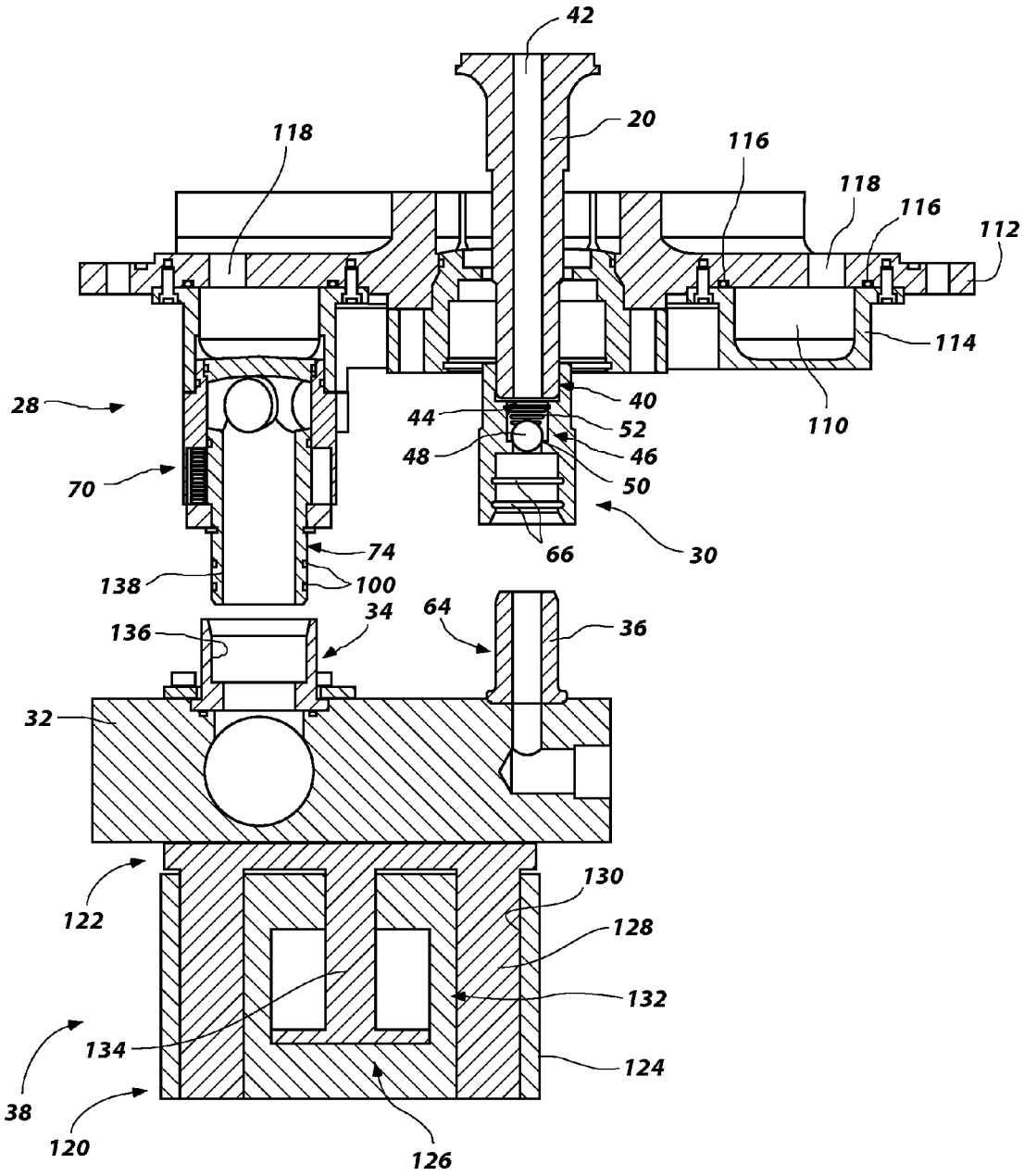
FIG. 2A shows a cross-sectional view of a movable manifold in a retracted position relative a bottom portion of a centrifugal separator, such as shown in FIG. 1.
Figure 2B:
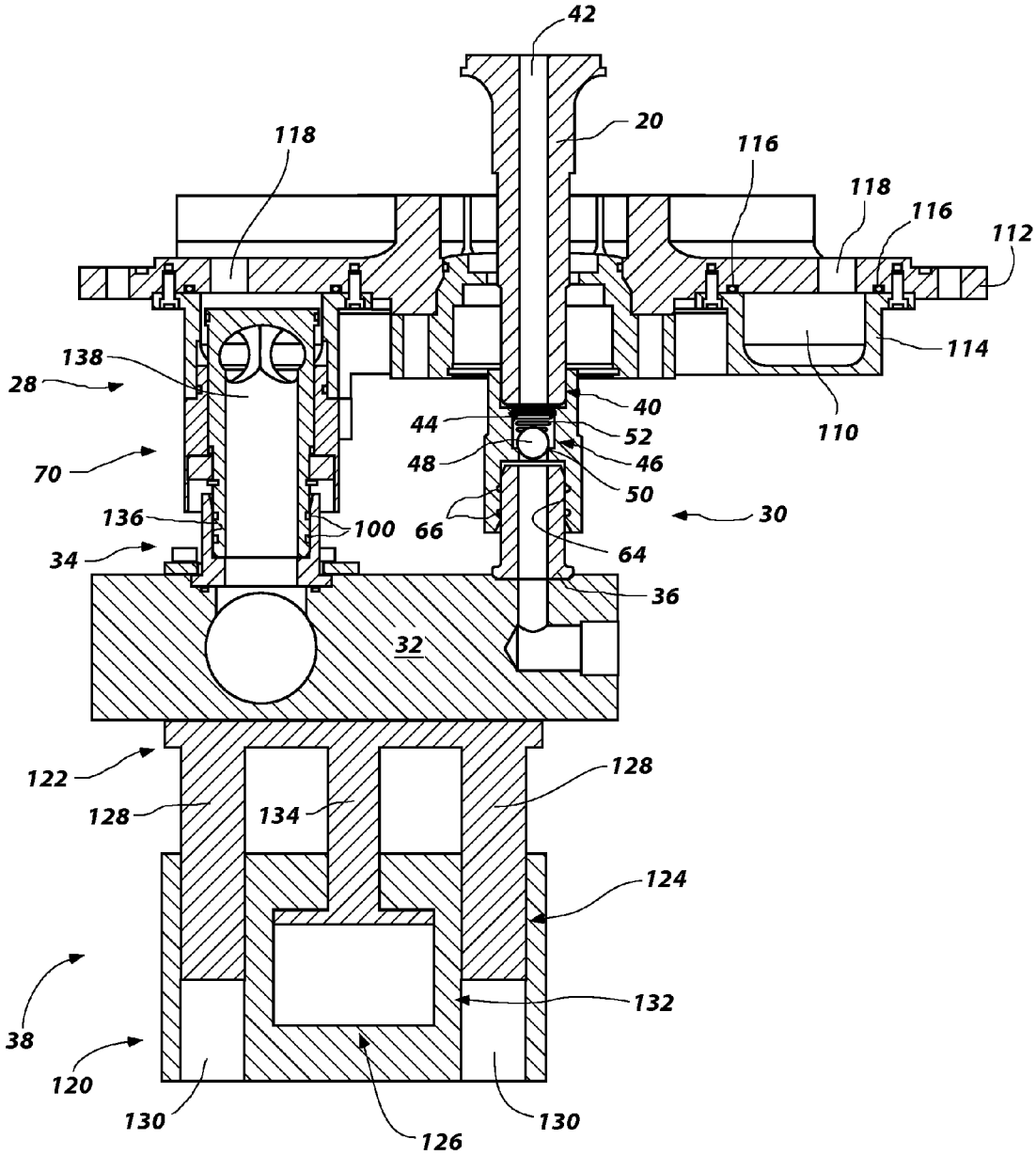
FIG. 2B shows a cross-sectional view of the movable manifold of FIG. 2A in a coupled position.

As shown in FIGS. 2A and 2B, the CIP fluid delivery fitting 30 may be located proximate a tail end 40 of the rotor shaft 20 of the centrifugal contactor 12 and coupled directly to the tail end 40 of the rotor shaft 20. The rotor shaft 20 includes a longitudinal fluid passage 42 having an opening 44 at the tail end 40 of the rotor shaft 20 fluidly coupled to the CIP fluid delivery fitting 30. As such, the CIP fluid delivery fitting 30 is configured to deliver fluid into the longitudinal fluid passage 42 of the rotor shaft 20 through the opening 44 at the tail end 40 of the rotor shaft 20.

The CIP fluid delivery fitting 30 may additionally include a valve located proximate the tail end 40 of the rotor shaft 20. The valve may comprise a check valve 46, as shown in FIGS. 2A and 2B, that may allow fluid flow in only one direction through the check valve 46, thus allowing fluid to flow through the CIP fluid delivery fitting 30 and enter the opening 44 at the tail end 40 of the rotor shaft 20 but not allow fluid flow exiting the opening 44 at the tail end 40 of the rotor shaft 20 to flow through the CIP fluid delivery fitting 30. For example, and as shown in FIGS. 2A and 2B, the check valve 46 may comprise a ball 48, a seat 50 and a spring 52. The spring 52 may provide a biasing force to seal the ball 48 against the seat 50 and when fluid pressure is applied through the seat 50 the fluid pressure may overcome force of the spring 52 and unseat the ball 48 and the fluid may flow through the seat 50 past the ball 48. However, when fluid pressure is applied in the other direction the fluid pressure may apply a force that maintains the ball 48 in a sealing position within the seat 50 and fluid may be prevented from passing through the seat 50.

Figure 3A:
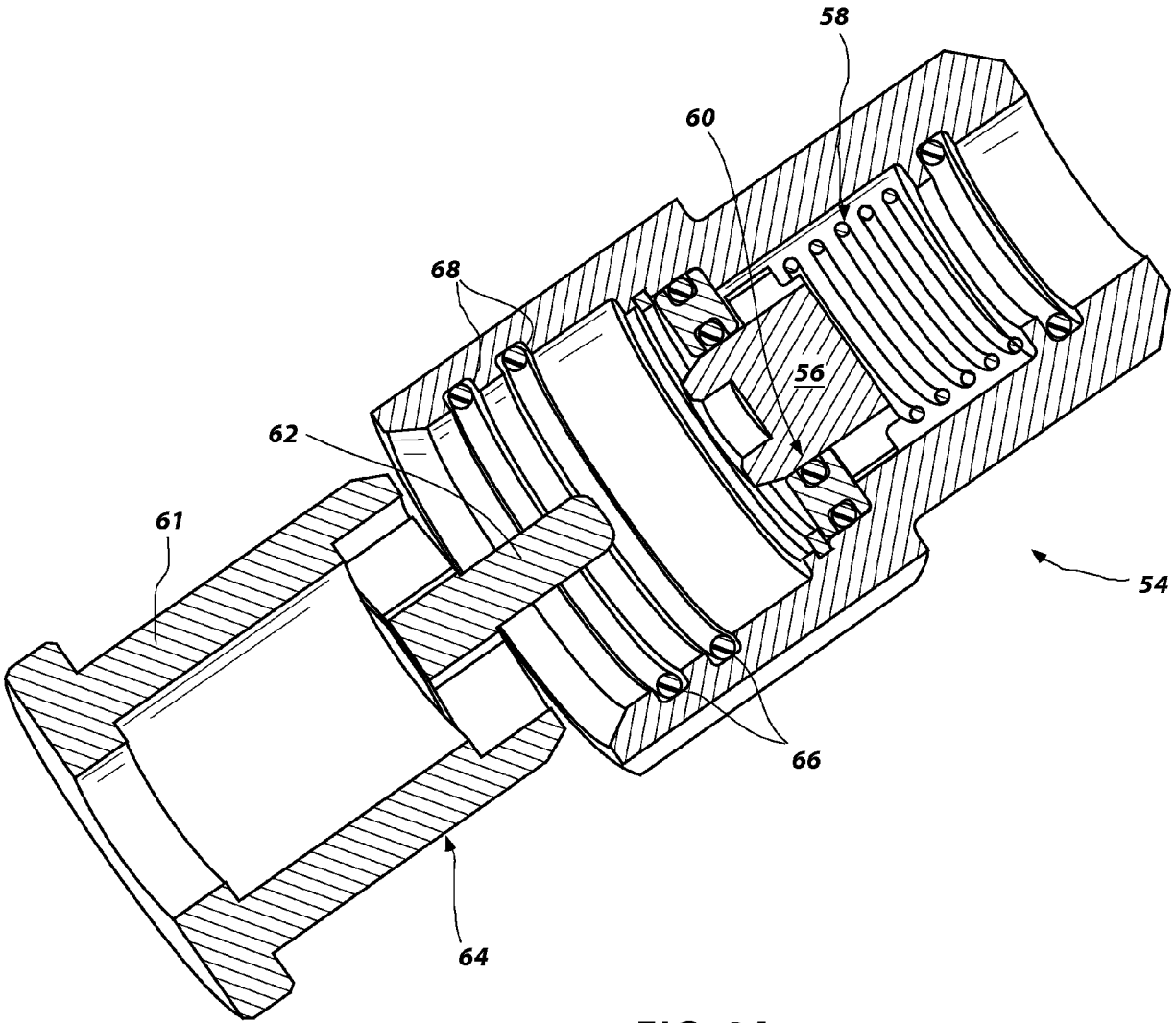
FIG. 3A shows a close-up cross-sectional view of a cleaning fluid valve assembly of a centrifugal separator, such as shown in FIG. 1.
Figure 3B:
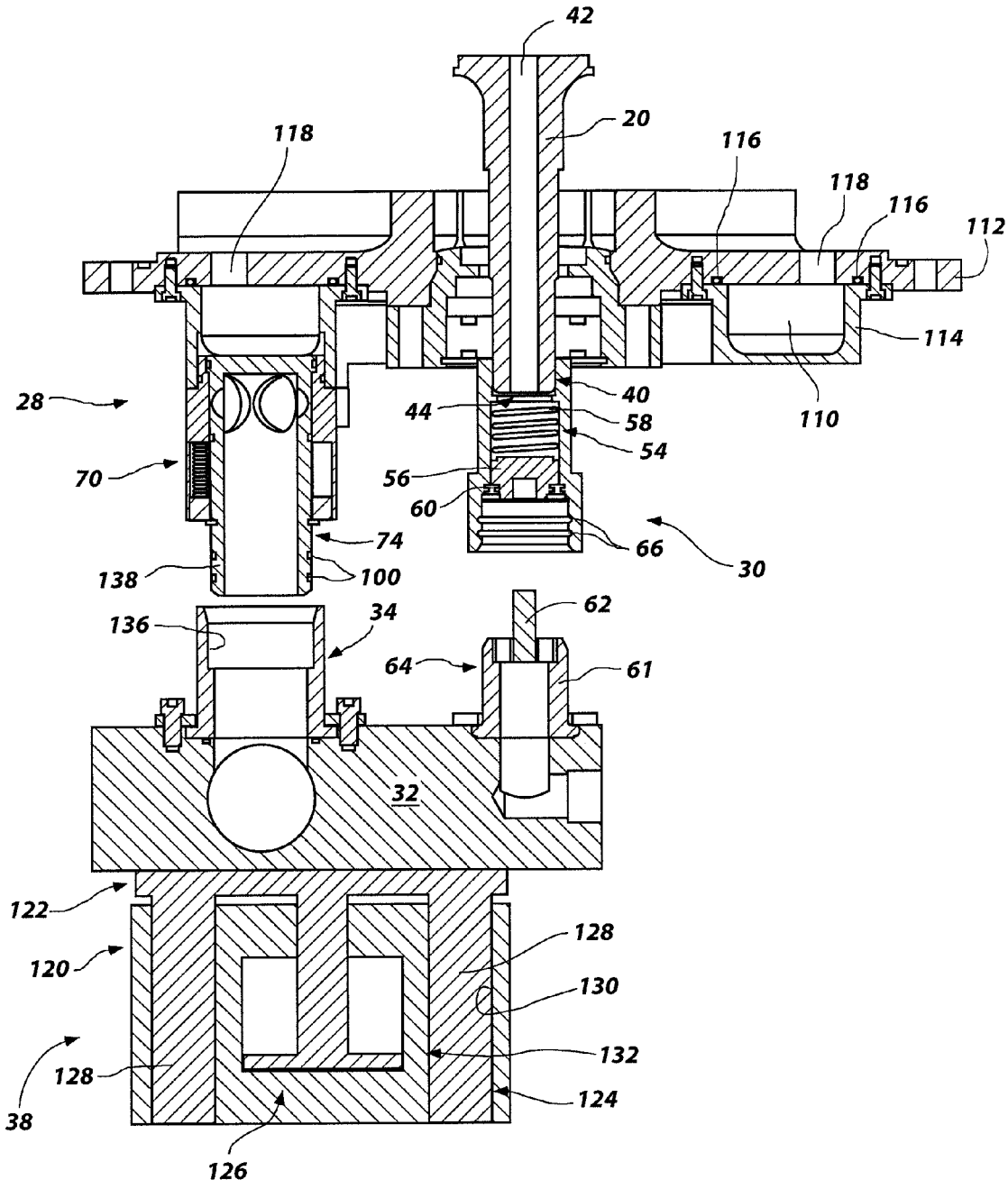
FIG. 3B shows a cross-sectional view of a movable manifold including a cleaning fluid valve assembly, such as shown in FIG. 3A, in a retracted position relative a bottom portion of one of the centrifugal separators of a centrifugal separator system, such as shown in FIG. 1.
Figure 3C:
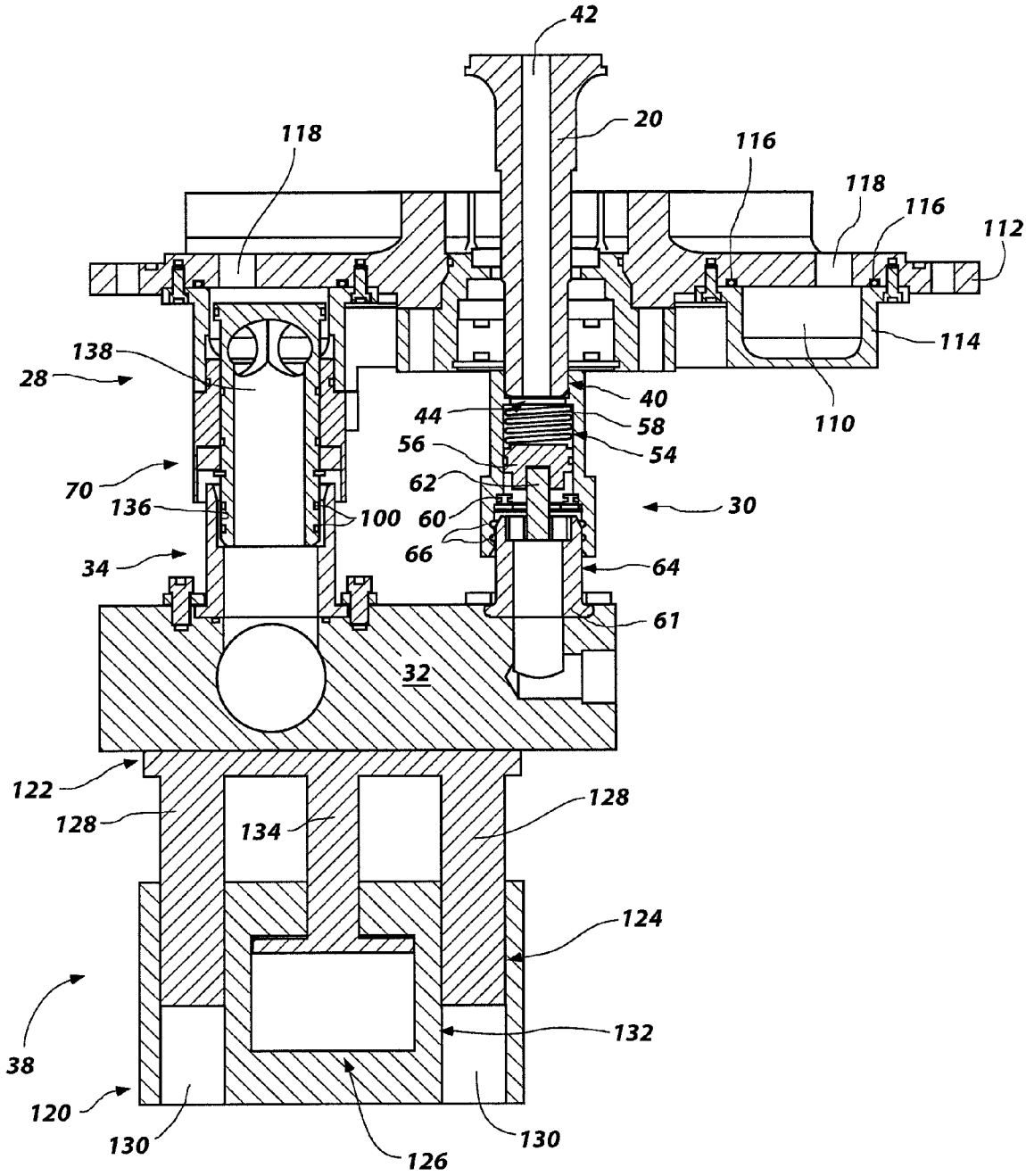
FIG. 3C shows a cross-sectional view of the movable manifold of FIG. 3B in a coupled position.

In an additional embodiment, the CIP fluid delivery fitting 30 may include a poppet valve 54, as shown in FIGS. 3A-3C. The poppet valve 54 may include a poppet 56, a biasing member, such as a spring 58, and a seat 60. A fluid supply fitting 61 may include a structural feature, such as a post 62, which may be configured to engage the poppet 56. The spring 58 may apply a force to the poppet 56 that may bias the poppet 56 against the seat 60 to form a seal between the poppet 56 and the seat 60 and prevent fluid from flowing through the seat 60, as shown in FIG. 3B. During the coupling of the fluid supply fitting 61 and the CIP fluid delivery fitting 30, the post 62 may engage the poppet 56 and overcome the biasing force of the spring 58 and cause the poppet 56 to disengage from the seat 60, as shown in FIG. 3C. Accordingly, while the fluid supply fitting 61 is coupled to the CIP fluid delivery fitting 30 fluid may flow through the seat 60. When the fluid supply fitting 61 is decoupled from the CIP fluid delivery fitting 30 the biasing force of the spring 58 may return the poppet 56 into sealing contact with the seat 60 to prevent fluid flow through the seat 60.

As shown in FIGS. 2A, 2B and 3A-3C, the fluid supply fitting 36 or 61 may comprise a substantially smooth surface portion 64 that is configured to slidably couple and seal with one or more elastic seals 66 of the CIP fluid delivery fitting 30. As shown in FIGS. 2B and 3C, upon coupling of the fluid supply fitting 36 or 61 and the CIP fluid delivery fitting 30, the smooth surface portion 64 of the fluid supply fitting 36 or 61 may compress a plurality of elastic seals 66, each seated in a seal gland 68 (FIG. 3A) in the CIP fluid delivery fitting 30, and form a fluid-tight seal between the fittings 30 and 36 or 61. For example, the plurality of elastic seals 66, and similarly other seals described herein, may be elastomeric O-rings, such as KALREZ® perfluoroelastomer O-rings available from DuPont Performance Elastomers L.L.C. of Wilmington, Del.

Figure 4:
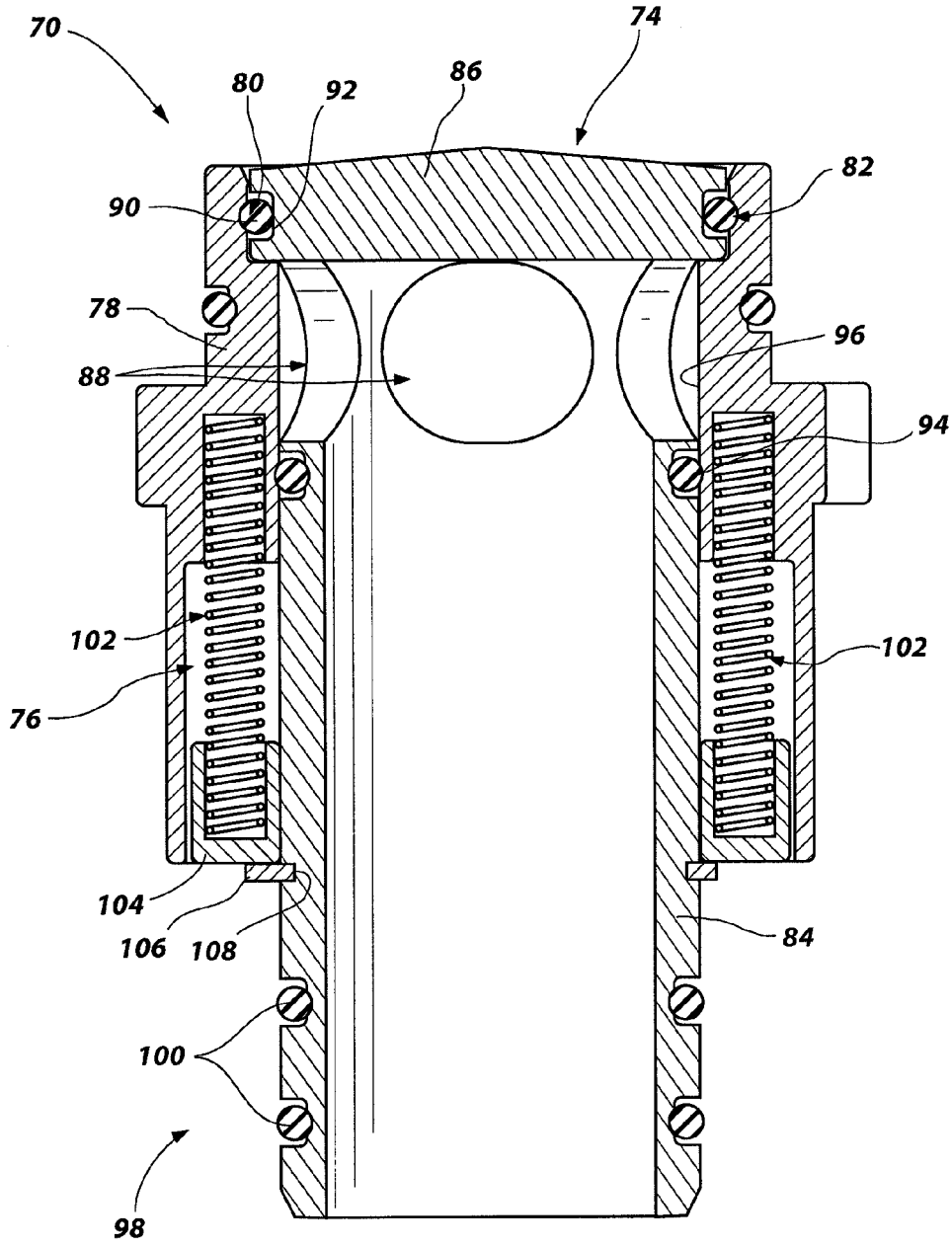
FIG. 4 shows a close-up cross-sectional view of a drain valve assembly, such as shown in FIGS. 2A, 2B, 3B and 3C.

As shown in FIGS. 2A, 2B, 3B and 3C the drain assembly 28 may comprise a drain valve assembly 70 located at the base of a fluid chamber of the centrifugal contactor 12. As shown in a more detailed cross-sectional view in FIG. 4, the drain valve assembly 70 may comprise a movable poppet 74, a biasing mechanism 76 coupled to the poppet 74 and a valve body 78 having a seat 80 sized and configured to seal with a sealing portion 82 of the poppet 74 to prevent fluid flow past the seat 80.

The poppet 74 of the drain valve assembly 70 may comprise an annular body 84, a head 86 coupled to the annular body 84 and a plurality of apertures 88 located in the annular body 84 proximate the head 86. The head 86 may be configured generally as a disc comprising the sealing portion 82 at the periphery thereof. The sealing portion 82 may include an elastic seal 90, such as an elastomer O-ring, positioned in a seal gland 92, which may be compressed against the seat 80 of the valve body 78 to form a fluid-tight seal between the head 86 and the seat 80. Additionally, an elastic seal 94 may be positioned below the apertures 88 in the annular body 84 and form a fluid-tight seal between the annular body 84 and a substantially smooth wall 96 of the valve body 78, such that fluid may not leak into the biasing mechanism 76 or outside of the drain valve assembly 70. The annular body 84 of the poppet 74 may extend out of the valve body 78 and include a sealing portion 98 comprising one or more elastic seals 100, such as elastomer O-rings, such that the annular body 84 of the poppet 74 may be sized and configured to slidably couple and seal with the drain fitting 34, as shown in FIGS. 2B and 3C.

The biasing mechanism 76 of the drain valve assembly 70 may comprise one or more helical springs 102 located between a portion of the valve body 78 and the poppet 74. The springs 102 may have one end positioned against a surface of the valve body 78 and another end positioned against a surface of a structure 104 coupled to the annular body 84 of the poppet 74. For example, the structure 104 may be an annular structure encircling the annular body 84 of the poppet 74 and positioned against a retaining ring 106 that is located in a groove 108 formed in the surface of the annular body 84 of the poppet 74. The biasing mechanism 76 may be configured to apply a biasing force against the poppet 74, which may cause the head 86 of the poppet 74 to seal against the seat 80 of the valve body 78 and prevent fluid flow therethrough.

Figure 5:
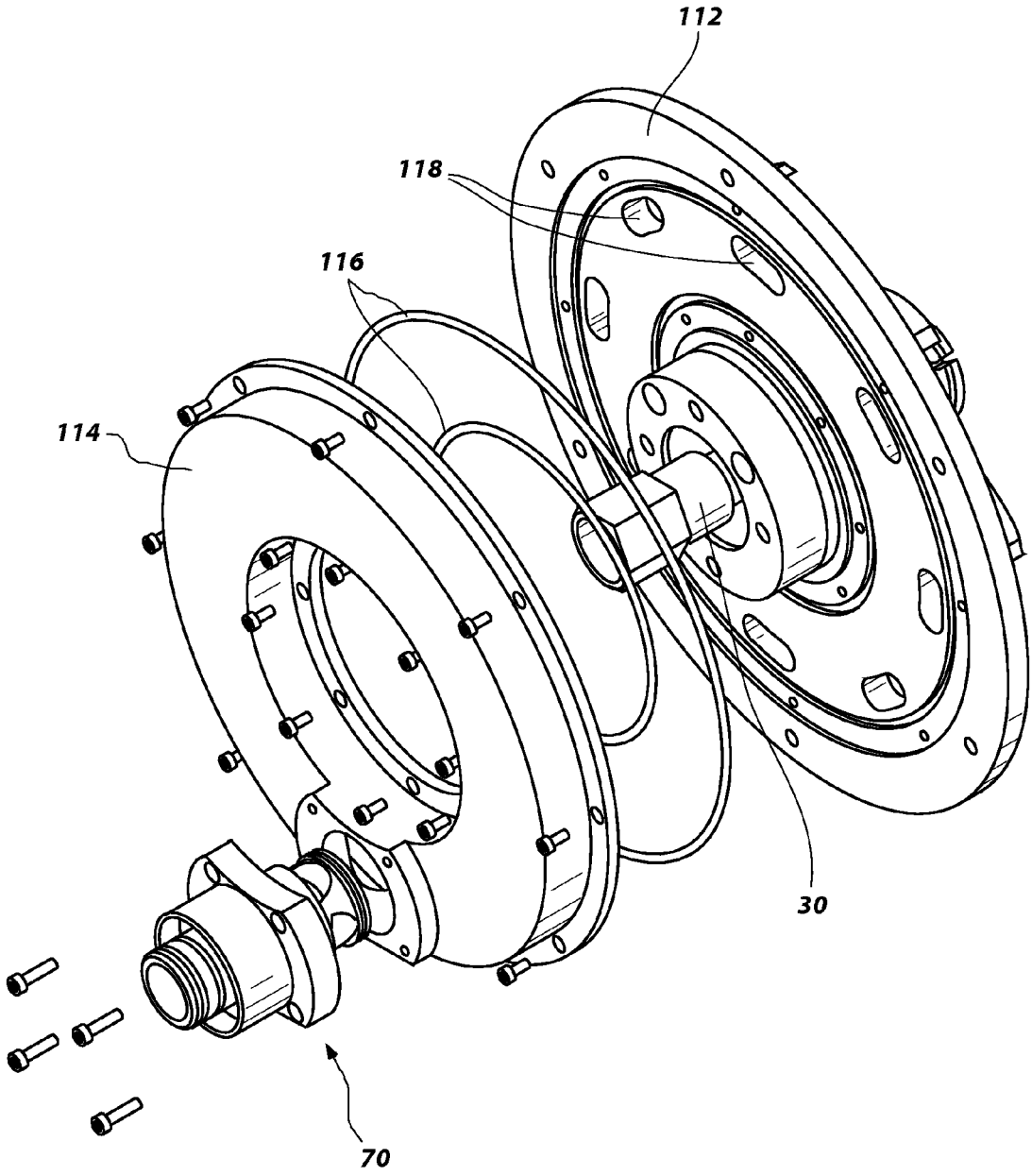
FIG. 5 shows an exploded view of a bottom portion of a centrifugal separator, such as shown in FIG. 1.

As shown in cross-sectional view in FIGS. 2A and 2B, and in an exploded view in FIG. 5, the drain assembly 28 may be located at the base of a solids collection chamber 110, formed between a bottom plate 112 of the centrifugal contactor 12 (FIG. 1) and a solids collector ring 114. The solids collector ring 114 may be sealed to the bottom plate 112 of the centrifugal contactor 12 with one or more seals 116 and positioned below a plurality of apertures 118 within the bottom plate 112. The apertures 118 in the bottom plate 112 may be sized and configured to allow the passage of solids from the separation chamber into the solids collection chamber 110, defined by the bottom plate 112 and the solids collector ring 114.

Referring again to FIGS. 2A, 2B, 3B and 3C, the manifold 32, which includes the drain fitting 34 and the fluid supply fitting 36 or 61, may be coupled to a support assembly 38 that includes a fixed member 120 and a movable member 122. The fixed member 120 may be fixed to the frame 14 (FIG. 1) and coupled to the movable member 122, which is coupled to the manifold 32, through a guide structure 124 and/or an actuator 126.

The guide structure 124 may be configured to constrain the movement of the movable member 122 to a fixed path, such as a linear path, relative the fixed member 120. For example, the guide structure 124 may comprise one or more guide rods 128 having one end coupled to the movable member 122. Each guide rod 128 may be positioned at least partially within a guide sleeve 130, such that the guide sleeves 130 may constrain the movement of the guide rods 128 and the movable member 122 to a fixed linear path.

The actuator 126 may be configured to move the movable member 122, and thus the manifold 32, the fluid supply fitting 36 or 61, and the drain fitting 34, along the fixed path relative the fixed member 120. For example, the actuator 126 may be a linear actuator, such as a pressure actuated cylinder assembly (as shown) or a mechanical actuator having a rotatable screw (not shown).

The actuator 126 may comprise a cylinder body 132 fixed to the frame 14 and a piston rod 134 fixed to the movable member 122. In additional embodiments, the cylinder body 132 may be fixed to the movable member 122 and the piston rod 134 may be fixed to the frame 14.

In an additional embodiment, the actuator 126 may be a mechanical actuator (not shown) comprising a rotatable screw mated with a floating nut. The floating nut may be fixed to the movable member 122 and the rotatable screw may be coupled to the frame 14. The floating nut may be coupled to the rotatable screw, such that the floating nut may translate along the rotatable screw as the screw is rotated. The screw may include a head at one end configured to mate with and be rotated by a tool. For example, the head may be shaped as a standard hexagonal bolt head.

During a centrifugal separation process, the motor of a centrifugal separator, such as the electric motor 18 of the centrifugal contactor 12, may rotate the rotor shaft 20, thus causing the centrifugal separation of the working fluids within the separation chamber. Additionally, the manifold 32 may be in a retracted position, such that the fluid supply fitting 36 or 61 may be separated and out of contact with the CIP fluid delivery fitting 30 and the drain fitting 34 may be separated and out of contact with the drain assembly 28, as shown in FIGS. 1, 2A and 3B. The drain valve assembly 70 may be in a closed position, such that the poppet 74 is sealed against the seat 80 of the valve body 78 and fluid may be prevented from flowing through the drain valve assembly 70. Also, the valve of the CIP fluid delivery fitting 30 may be in a closed position, such that fluid may be prevented from flowing through the valve.

To initiate a clean-in-place procedure, the flow of additional working fluid into the centrifugal contactor 12 may be prevented. The electric motor 18 may be stopped so that the rotor shaft 20 and the CIP fluid delivery fitting 30 coupled to the tail end 40 of the rotor shaft 20 are held substantially stationary. Then the actuator 126 may be operated to move the movable member 122 from a retracted position (as shown in FIGS. 2A and 3B) to a coupled position (as shown in FIGS. 2B and 3C). The movement of the movable member 122 by the actuator 126 may cause the fluid supply fitting 36 or 61 to be moved into contact and coupled with the CIP fluid delivery fitting 30 and the drain fitting 34 to be substantially simultaneously moved into contact and coupled with the drain assembly 28.

If a pressure actuated cylinder is used as the actuator 126, pressurized fluid may be supplied to the actuator 126 to operate the actuator 126 and cause the movable member 122 to be moved along the linear path from the retracted position to the coupled position. For example, if a pneumatic cylinder is used, a pressurized gas, such as air, may be supplied to the pneumatic cylinder. If a hydraulic cylinder is used, a pressurized liquid, such as hydraulic oil, may be supplied to the hydraulic cylinder. Likewise, if a screw and floating nut mechanism is used, a rotational force may be applied to the screw to operate the actuator and cause the movable member to move along a fixed path.

As the fluid supply fitting 36 or 61 is moved into contact with and is slid into the CIP fluid delivery valve 30 the smooth surface portion 64 of the fluid supply fitting 36 or 61 may be pressed against and compress the elastic seals 66 of the CIP fluid delivery fitting 30 between the fluid supply fitting 36 or 61 and the CIP fluid delivery fitting 30 creating a fluid-tight seal between the coupled fittings 30 and 36 or 61. If the CIP fluid delivery fitting 30 includes a poppet valve 54, such as shown in FIGS. 3A-3C, the poppet valve 54 may be caused to open as the fluid supply fitting 61 is coupled with the CIP fluid delivery fitting 30. For example, the post 62 attached to the fluid supply fitting 61 may apply a force to the poppet 56 and cause the poppet 56 to move and unseal from the seat 60 and create an opening between the poppet 56 and the seat 60.

Meanwhile, the drain fitting 34 may be moved into contact with and slid over the annular body 84 of the movable poppet 74 of the drain valve assembly 70. A substantially smooth portion 136 of the drain fitting 34 may be pressed against the elastic seals 100 of the sealing portion 98 of the annular body 84 and compress the seals 100 between the drain fitting 34 and the annular body 84 of the poppet 74 to form a fluid-tight seal. Substantially simultaneously, the drain fitting 34 may apply a force to the annular body 84 of the poppet 74 and displace the poppet 74 to unseal the sealing portion 82 of the poppet 74 from the seat 80 of the valve body 78, thus causing the drain valve assembly 70 to open, as shown in FIGS. 2B and 3C. As the drain valve assembly 70 opens, the working fluid, and any solids suspended in the working fluid, in the centrifugal contactor 12 may flow through the apertures 88 (FIG. 4) and then through a central bore 138 of the poppet 74. The working fluid may then flow through the drain fitting 34 and out the manifold 32 into an attached drain line (not shown).

After the working fluids have been substantially drained from the centrifugal contactor 12 a pressurized cleaning fluid may be directed from the fluid supply fitting 36 or 61 into the CIP fluid delivery fitting 30 and into the longitudinal fluid passage 42 of the rotor shaft 20. For example, the pressurized cleaning fluid may comprise at least one of a solvent, an organic solvent, detergent, and water. Directing the fluid through the CIP fluid deliver fitting 30 may comprise directing the fluid through the check valve 46 (as shown in FIG. 2B) or through the poppet valve 54 (as shown in FIG. 3C). Directing fluid through the check valve 46 may be accomplished by supplying the cleaning fluid at a pressure sufficient to create a force against the ball 48 that may overcome the biasing force applied to the ball 48 by the spring 52 and cause the ball 48 to move away from the seat 50 and allow the cleaning fluid to flow through the check valve 46. Directing pressurized cleaning fluid through the poppet valve 54 may be accomplished by simply directing the cleaning fluid through the space between the poppet 56 and the seat 50 caused by the displacement of the poppet 56 by the fluid supply fitting 61.

The pressurized cleaning fluid may then be directed through the longitudinal fluid passage 42 of the rotor shaft 20 and be sprayed out of one or more nozzles (not shown) located along the rotor shaft 20. The spray from the nozzles may wash debris from surfaces of the separation chamber. The debris may be directed by gravity and the flow of the cleaning fluid through the apertures 118 in the bottom plate 112 of the centrifugal contactor 12 and into the solids collection chamber 110. The debris and cleaning fluid may then flow out of the solids collection chamber 110 through the drain valve assembly 70 in a manner similar to the prior draining of the working fluids.

Optionally, after supplying the cleaning fluid, a rinsing fluid, such as substantially pure water, may be directed through the longitudinal fluid passage 42 of the rotor shaft 20 in a manner similar to the cleaning fluid. The rinsing fluid may be used to rinse the cleaning fluid from the separation chamber of the centrifugal contactor 12 and out the drain assembly 28.

After the cleaning fluid and, optionally, the rinsing fluid, have been substantially drained from the centrifugal contactor 12, the actuator 126 may be operated to retract the movable member 122 and manifold 32. This may substantially simultaneously move the fluid supply fitting 36 out of contact with the CIP fluid delivery fitting 30, move the drain fitting 34 out of contact with the drain assembly 28, cause the poppet 74 of the drain valve assembly 70 to be biased to a closed position and optionally cause the poppet 56 of the poppet valve 54 of the CIP fluid delivery fitting 30 to be biased to a closed position. Working fluids may then be reintroduced into the separation chamber, the electric motor 18 may cause the rotor shaft 20 to rotate and the centrifugal contactor 12 may be returned to regular fluid separation service.

While specific embodiments of the invention have been shown by way of example in the drawings and have been described in detail herein, the invention is not limited to the particular forms disclosed. Rather, the invention includes all modifications, equivalents, and alternatives falling within the scope of the invention as defined by the following appended claims and their legal equivalents.

What is claimed is:

1. A centrifugal separator comprising:

a rotor shaft comprising a longitudinal fluid passage therein having an opening at a tail end of the rotor shaft; and a first fluid supply fitting proximate the tail end of the rotor shaft and configured to deliver fluid into the longitudinal fluid passage through the opening;

a second fluid supply fitting sized and configured to sealingly couple with the first fluid supply fitting; and a support assembly comprising:

a fixed member;

a movable member coupled to the second fluid supply fitting and coupled to the fixed member such that the movable member is constrained to movement along a fixed path relative to the fixed member; and an actuator configured to move the movable member along the fixed path.

2. The centrifugal separator of claim 1, wherein the first fluid supply fitting is coupled directly to the tail end of the rotor shaft.

3. The centrifugal separator of claim 1, wherein the first fluid supply fitting further comprises a valve located proximate the tail end of the rotor shaft.

4. The centrifugal separator of claim 3, wherein the valve comprises a check valve configured to allow the passage of fluid into the longitudinal fluid passage through the opening.

5. The centrifugal separator of claim 1, wherein the second fluid supply fitting comprises a substantially smooth surface portion configured to slidably couple and seal with an elastic seal of the first fluid supply fitting.

6. The centrifugal separator of claim 5, wherein the elastic seal of the first fluid supply fitting comprises at least one elastomeric O-ring.

7. The centrifugal separator of claim 1, further comprising:

a drain valve assembly located at the base of a fluid chamber of the centrifugal separator, the drain valve assembly comprising:

a movable poppet;

a seating mechanism coupled to the poppet; and a seat sized and configured to seal with a sealing portion of the poppet to prevent fluid flow past the seat; and a manifold comprising the second fluid supply fitting and a drain fitting, the manifold coupled to the movable member of the support assembly;

wherein the drain fitting is sized and configured to slidably couple and seal with a component of the drain valve assembly and to displace the poppet to unseal the sealing portion of the poppet from the seat to allow fluid flow past the seat.

8. The centrifugal separator of claim 7, wherein the drain fitting is sized and configured to slidably couple and seal with the movable poppet.

9. The centrifugal separator of claim 8, wherein the movable poppet of the drain valve assembly comprises:

an annular body having at least one sealing feature sized and configured to slidably seal against a surface of the drain fitting;

a head comprising the sealing portion of the poppet, the head coupled to the annular body; and a plurality of apertures located in the annular body proximate the head.

10. The centrifugal separator of claim 9, wherein the first fluid fitting comprises a poppet valve and wherein the second fluid fitting is sized and configured to cause the poppet valve to open upon coupling with the first fluid fitting.

11. The centrifugal separator of claim 9, further comprising a generally annular-shaped solids collecting chamber located below a bottom plate of the centrifugal separator, and wherein the drain valve assembly is located at the base of the solids collecting chamber.

12. The centrifugal separator of claim 7, wherein the fixed path is a fixed linear path and wherein the actuator is a linear actuator.

* * * * *